United States Patent [19]

Murakami

[11] 4,091,702

[45] May 30, 1978

[54] STRING MUSICAL INSTRUMENT HAVING A KEYBOARD

[75] Inventor: Kazuo Murakami, Hamamatsu, Japan

[73] Assignee: Nippon Gakki Seizo Kabushiki Kaisha, Japan

[21] Appl. No.: 711,155

[22] Filed: Aug. 3, 1976

[30] Foreign Application Priority Data

| | | |
|---|---|---|
| Aug. 11, 1975 | Japan | 50-97350 |
| Feb. 23, 1976 | Japan | 51-20283[U] |
| Feb. 23, 1976 | Japan | 51-20284[U] |

[51] Int. Cl.[2] ..... G10H 3/00

[52] U.S. Cl. ..... 84/1.16; 84/1.14; 84/173; 84/258; 84/423

[58] Field of Search ..... 84/1.16, 173, 236, 250, 84/251, 258, 423, 433

[56] References Cited

U.S. PATENT DOCUMENTS

| | | | |
|---|---|---|---|
| 2,996,942 | 8/1961 | Jewett | 84/423 |
| 3,146,658 | 9/1964 | Manoy et al. | 84/423 |
| 3,200,689 | 8/1965 | Rosberger | 84/423 |
| 3,319,502 | 5/1967 | Hackhet | 84/258 |
| 3,397,604 | 8/1968 | Seybold | 84/258 |
| 3,525,283 | 8/1970 | Pavia | 84/173 |
| 3,931,752 | 1/1976 | Mussulman | 84/1.16 |

*Primary Examiner*—Robert K. Schaefer
*Assistant Examiner*—Vit W. Miska
*Attorney, Agent, or Firm*—Flynn & Frishauf

[57] ABSTRACT

A keyboard musical instrument comprises a plurality of juxtaposed movable key units and a plurality of juxtaposed strings, each of which has one end fixed to the corresponding key unit and the other end immovably attached to the body of the key board musical instrument and is vibrated at a prescribed frequency upon operation of the corresponding key unit, wherein each string is prevented from making vibration by a stationary damping member while the corresponding key unit remains inoperative and commences vibrations at a prescribed frequency upon operation of the key unit; and the vibrations are electrically detected by pickup devices and, after amplified, are sent forth through a loud-speaker as a musical tone.

15 Claims, 19 Drawing Figures

STRING MUSICAL INSTRUMENT HAVING A KEYBOARD

BACKGROUND OF THE INVENTION

1. Field of the Invention

This invention relates to a keyboard musical instrument, wherein the mechanical vibrations of the strings connected to the key units are converted into musical tones after electrically picked up.

2. Description of the Prior Art

A piano is a known keyboard musical instrument, but is too heavy to be easily carried. To make up for the shortcomings of the ordinary piano, there has recently been developed an electric piano as a portable keyboard musical instrument resembling the conventional piano in respect of the musical tones produced as well as the method of playing.

The electric piano is provided with mechanical sound generators such as tuning forks and reeds corresponding to the respective tone pitches. Upon key depression, a key unit is actuated to strike a generator having a tone pitch corresponding to a key depressed, thereby generating a musical tone by the vibrations of the generator. These generator vibrations are electrically picked up to be sent forth as a musical tone through a loud-speaker.

With the above-mentioned type of electric piano, the sound generator is hit upon key depression, making it necessary to provide a hammer action mechanism like that used with the ordinary piano and consequently presenting difficulties in sufficiently simplifying the arrangement of the electric piano for miniaturization. For this purpose, the generator itself also has to be fully shortened. However, the generator thus shortened substantially fails to produce harmonics, though capable of providing a fundamental frequency corresponding to a given tone pitch, thus preventing a tone played on the electric piano from presenting a musical effect closely resembling that of the ordinary piano.

To eliminate the drawbacks of the tuning fork or reed used as a generator, it has been proposed to use a string. This process is to stretch a string having a prescribed length corresponding to a tone pitch with both ends fixed, strike the string upon key depression by a hammer action mechanism and electrically pick up the vibrations of the string. In this case, too, it is necessary to provide an action mechanism corresponding to a tone pitch obtained from each string. Therefore, an attempt to lighten and miniaturize the proposed electric piano is naturally subject to certain limitation.

SUMMARY OF THE INVENTION

It is accordingly the object of this invention to provide a portable keyboard musical instrument having a compact size and light weight and capable of producing a musical effect closely resembling that of the ordinary piano.

According to an aspect of this invention, there is provided a keyboard musical instrument which comprises a plurality of juxtaposed key shanks swingably supported at the intermediate point; a plurality of juxtaposed strings capable of being vibrated at different prescribed frequencies one end of each string being fixed to one end of the corresponding key shank and the other end thereof being immovably secured to the body of the musical instrument; and a stationary dampling member which is so positioned as to be pressed against a string connected to the corresponding key shank while it remains inoperative to suppress the vibrations of the string, but removed from the string upon key depression followed by the operation of the key shank. Upon operation of the key shank, one end of the corresponding string is vertically vibrated at an inherent frequency. Electric pickups are provided close to the strings at right angles thereto electrically to pick up the vibrations of the strings. After amplified, the vibrations thus detected are sent forth as musical tones through a loud-speaker.

The key shank may be made shorter as the corresponding string has a higher tone pitch. The string may be horizontally stretched at right angles to the corresponding key shank. This arrangement is effective to decrease the depth of the keyboard musical instrument of this invention.

It is possible to replace the key shank by a key unit comprising a key shank rotatable at its intermediate point and a swing lever, one end of which extends above one end of the key shank and the other end of which is securely connected to the corresponding string.

BRIEF DESCRIPTION OF THE DRAWING

This invention can be fully understood from the following detailed description with reference to the accompanying drawings in which.

DETAILED DESCRIPTION OF THE PREFERRED EMBODIMENTS

Figure 1:
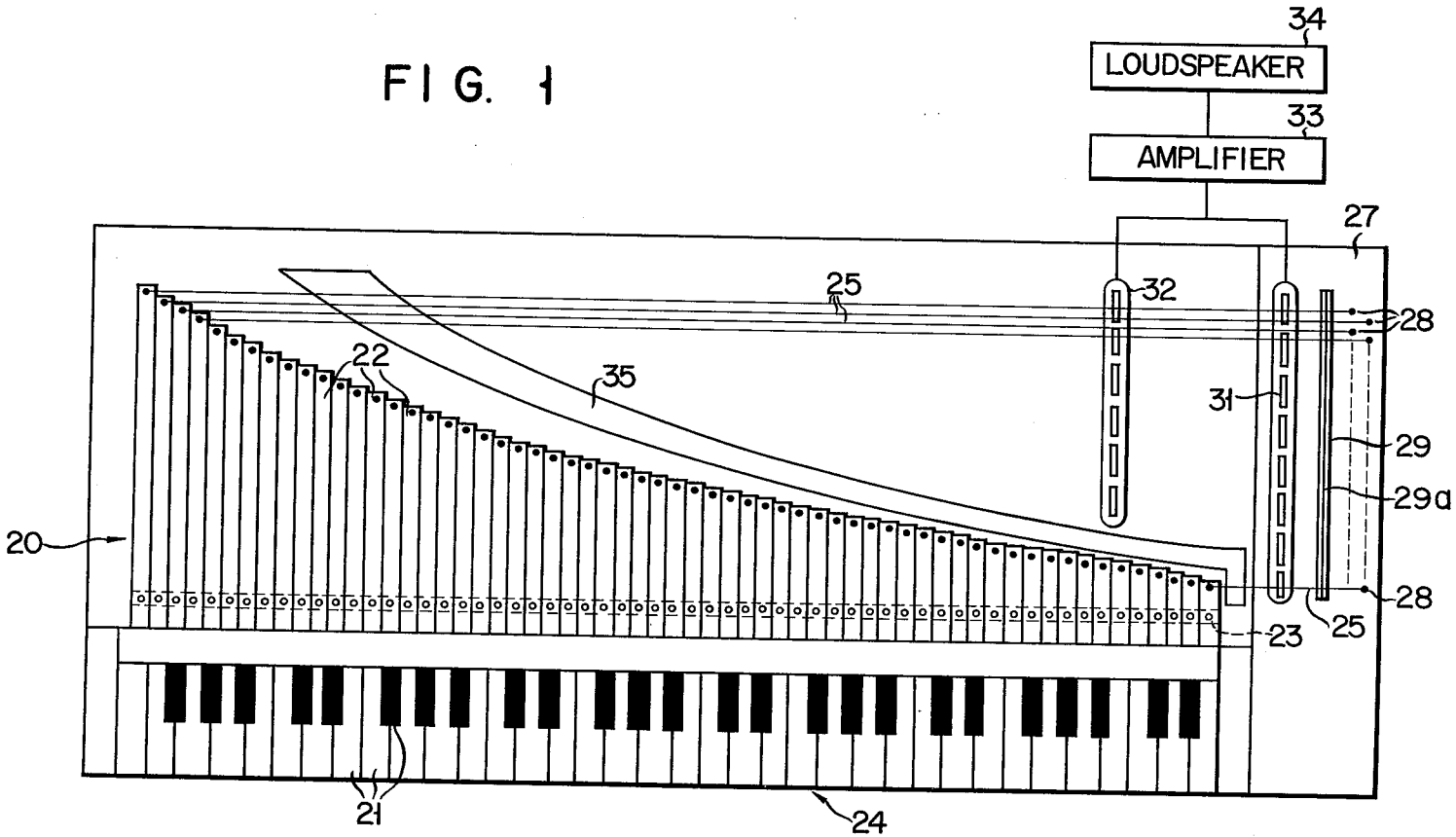
FIG. 1 is a schematic plan view of a keyboard musical instrument according to an embodiment of this invention.
Figure 2:
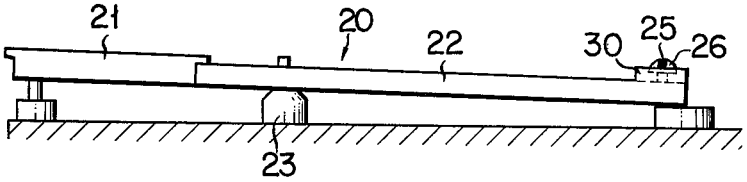
FIG. 2 is a side elevation of a key unit included in the keyboard musical instrument of FIG. 1.

Throughout the specification, the same and similar sections and parts are denoted by the same numerals.

There will now be described by reference to FIG. 1 a keyboard musical instrument according to an embodiment of the present invention. This musical instrument comprises a plurality of juxtaposed key units 20. The key unit 20 comprises a playing key 21 constituting the forward end portion and a key shank 22 integrated therewith. The intermediate part of the key shank 22 of the key unit 20 is supported on a balance rail 23 extending at right angles to each key shank 22. A key shank 22 corresponding to a depressed key 21 is rotated about the balance rail 23, causing the rear portion of the key shank 22 to be lifted. The keys 21 collectively constitute a keyboard 24 as in the conventional piano. The key shanks 22 are made progressively shorter, as illustrated in FIG. 1, as they represent higher tone pitches.

Figure 3:
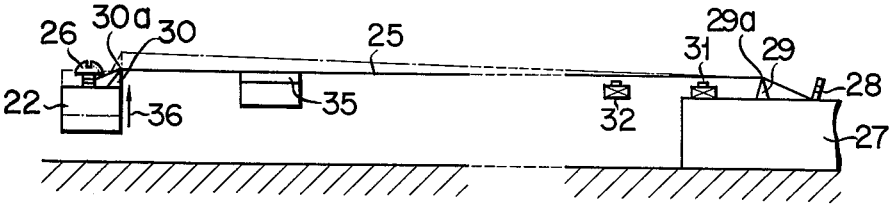
FIG. 3 is a front view of one of the key units of the keyboard musical instrument of FIG. 2, showing the arrangement of the various sections and parts of the key unit.

Referring to FIGS. 1 and 3, one end of a string 25 is connected to the rear end of the key shank 22 by means of a screw 26, and the other end of the string 25 is connected to a pin 28 secured to a mount 27 provided on the body of the keyboard musical instrument. The string 25 is horizontally stretched with a proper tension at right angles to the key shank 22, namely, in parallel with the keyboard 24. Strings 25 positioned nearer to the keyboard 24 produce tones having a higher pitch. Though only some of the strings 25 are indicated in FIG. 1 for briefness of representation, one string 25 is provided for each key unit 20.

A string support member 29 having a triangular cross section is provided on the mount 27 near the inner side of the pin 28 at right angles to the string 25. The string 25 rests on the apical edge 29*a* of the support member 29 at a point near the aforesaid other end of the string 25. Another string support member 30 having a triangular cross section is provided at the rear end of the key shank 22 close to the inner side of the screw 26. The string 25 rests on the apical edge 30*a* of the support member 30 at a point near the aforesaid one end of the string 25. A distance between both string support members 29, 30 defines the effective length of the string 25 for its vibrations at a prescribed frequency. Pickups 31, 32 are provided below the string 25 crosswise thereof to electrically detect the mechanical vibrations of the string 25 and convert the detected vibrations into electric signals. After amplified by an amplifier 33 (FIG. 1) the electric signals are sent forth as a musical tone through a loudspeaker 34 (FIG. 1).

FIG. 3 shows the arrangement of various sections and parts associated with one of the key shanks 22 included in the key unit 20 of a keyboard musical instrument according to an embodiment of this invention. As previously mentioned, the screw 26 and pin 28 securely fixing both ends of the string 25 stretched between the support members 29, 30 adjust the tension of the string 25 to admit of tuning. A damping member 35 (FIG. 3 indicates that portion of the damping member 35 which is associated with the string 25) is provided below the strings 25 immovably relative to the keyboard musical instrument so as to cross all the strings 25 along an arcuate line defined by the rear ends of the juxtaposed key shanks 22. Where the key 21 is not depressed with the rear end of the key shank 22 kept at a low position, the damping member 35 touches the string 25 to suppress its vibrations. When the rear end of the key shank 22 is quickly lifted upon key depression in the direction of an arrow 36 shown in FIG. 3, the damping member 35 is removed from the string 25. The quick lifting of the damping member 35 causes the string 25 to be vibrated at a frequency corresponding to the effective length of the string 25 defined by the support members 29, 30 and the tension applied to the string 25. The mechanical vibrations of the string 25 are detected by the pickups 31, 32, and after amplified by the amplifier 33, are sent forth through the loudspeaker 34 as a musical tone having a pitch corresponding to a key 21 depressed. When the depressed key 21 is released, the rear end of the key shank 22 is brought down to the original position, and the mechanical vibrations of the string 25 is suppressed by the damping member 35, immediately stopping the production of a musical tone. Accordingly, the keyboard musical instrument of this invention enables the same musical tones as obtained from the ordinary piano to be produced through the loudspeaker 34.

With the keyboard musical instrument of this invention constructed as described above, the tension of the string 25 applied to the key 21 as a lateral force need not be very strong, allowing the key 21 to have a sufficient mechanical strength to withstand a bending force exerted by the string 25.

Figure 4:
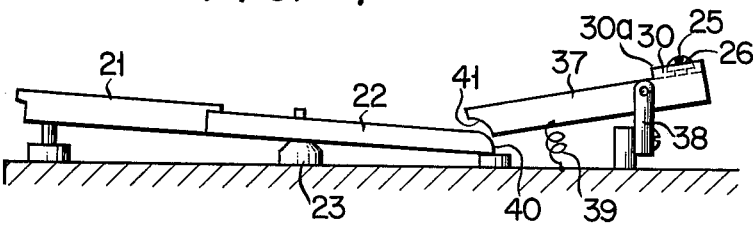
FIG. 4 is a side elevation of a key unit according to another embodiment of the invention.
Figure 5:
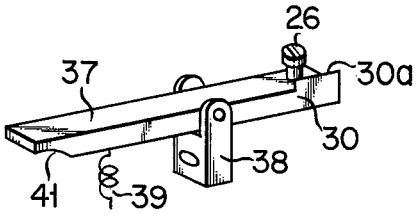
FIG. 5 is a perspective view of a swing lever of the key unit of FIG. 4 and the parts associated with the swing lever.
Figure 6:
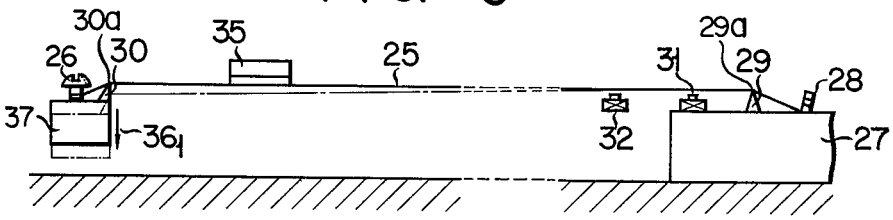
FIG. 6 is a front view of the arrangement of the various sections and parts associated with one of the key units of the keyboard musical instrument which are illustrated in FIGS. 4, 5, 7, 8(A) to 8(C), and 9 to 16.

Where, however, the string 25 is desired to have an increased tension or it is considered necessary to eliminate the possibility of an excessive bending force being applied by the tightly stretched string 25 to the key 21, it is advised to construct the key unit as illustrated in FIGS. 4 and 5 according to the above-mentioned requirement. FIG. 4 illustrates a key unit 20 thus modified. The key unit 20 comprises a key 21, a key shank 22 whose forward end is fixed to the rear end of the key 21 and which is rotated about a balance rail 23 at an intermediate point and a swing lever 37 where forward end extends above the rear end of the key shank 22 and which is rotatably supported by a flange 38. The forward end of the swing lever 37 is normally pressed against the surface of the rear end portion of the key shank 22 by means of a helical tension spring 39. A screw 26 for fixing one end of the string 25 to the rear end portion of the key shank 22 and a key support 30 for holding the string 25 at a point near said one end are provided on the rear upper surface of the swing lever 37. With the key unit 20 according to the embodiment of FIG. 4, the forward end of the swing lever 37 is pushed up by the key shank 22 upon key depression and is rotated clockwise of FIG. 4 to quickly raise said one end of the corresponding string 25 thereby causing the string 25 to be vibrated. In this case, the string 25 is brought downward upon key depression contrary to the preceding embodiment, namely, in the direction of the arrow 36 of FIG. 6. Therefore, the damping member 35 is brought, as shown in FIG. 6, into contact with the upper side of the stretched string 25. Like FIG. 3, FIG. 6 shows the key shank 22 of the key unit 20 and the various sections and parts associated wth said key shank 22.

Referring to FIG. 4, the rear end surface of the key shank 22 constitutes a convex section 40, and the forward end surface of the swing lever 37 which faces the rear end surface of the key shank 22 forms a concave section 41. Provision of a separate swing lever 37 as described above enables the key 21 to have a stronger resistance to the bending force of the corresponding string 25. Moreover, the rotation of the swing lever 37 is terminated in a shorter time than that during which the key 21 is operated, causing the vibration of the string 25 to cease in a shorter time than otherwise. As the result, the embodiments of FIGS. 4 and 5 provide such percussive musical tones as are generated by the conventional piano.

FIG, 7 shows a key unit 20 according to another embodiment of the present invention. This key unit 20 has substantially the same construction as those of FIGS. 4 and 5. The only difference is that the rear end convex section 40 of the key shank 22 of the key unit of FIG. 7 and the forward end concave section 41 of the swing lever 37 of the key unit 20 are coated with lubricating materials 42, 43 respectively such as polytetrafluoroethylene or carbon.

Figure 7:
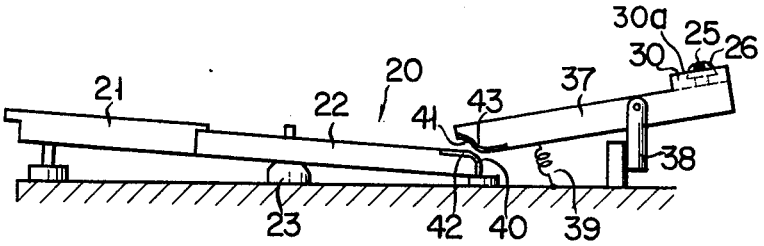
FIG. 7 is a side elevation of a key unit according to another embodiment of the invention.
Figure 8A:
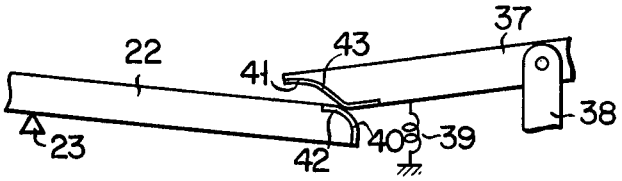
FIGS. 8(A) to 8(C) are side elevations showing the operation of the key unit of FIG. 7.
Figure 8B:
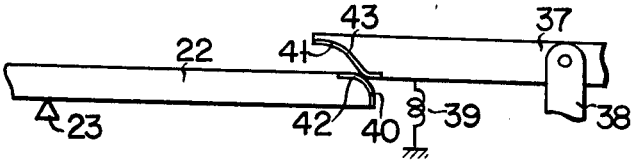
Figure 8C:
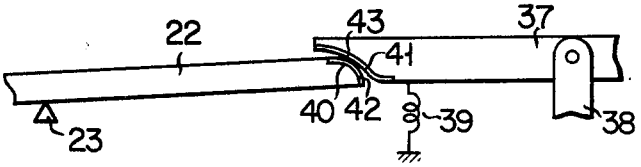

When the key unit 20 of FIG. 7 is not operated, the bottom of the concave forward end surface of the swing lever 37 is placed, as shown in FIG. 8(A), on or above the upper part of the convex rear end surface of the key shank 22. The string 25 connected to the rear end of the swing lever 37 stands at rest in a lifted position in contact with the damping member 35 and is prevented from being vibrated. Upon key depression, the convex rear end surface 40 of the key shank 22 is lifted as shown in FIG. 8(B) to push up the concave forward end surface 41 of the swing lever 37, causing the swing lever 37 to be rotated clockwise against the force of a tension spring 39. As a result, the string 25 removed from the damping member 35 is vibrated to produce a musical tone. Where the key 21 is further depressed, the lower part of the concave forward end surface 41 of the swing lever 37 is disengaged from the upper part of the convex rear end surface 40 of the key shank 22, and the rear end of the swing lever 37 makes a rapid sliding movement towards the key shank 22 with respect to the latter so as to cause the intermediate portions of both surfaces 40 and 41 to be engaged with each other, as shown in FIG. 8(C). Where the operating condition of the key unit 20 is shifted from FIG. 8(B) to FIG. 8(C), the slight counterclockwise rotation of the swing lever 37 produces a sense of so-called "escape" and imparts a slight mechanical impact to the key shank 22 and in consequence the key 21. This mechanical impact is transmitted to a player's finger tips. Accordingly, the player is given a similar sense of key touch to that which is obtained from the key action mechanism of the ordinary piano, and can enjoy good performance feeling. While the embodiments of FIGS. 4 to 6 are operated with the similar effect to described above, the key unit 20 of FIGS. 7 and 8(A) to 7(C) is more smoothly operated than said embodiments, because the convex rear end surface 40 of the key shank 22 and the concave forward end surface 41 of the swing lever 37 are coated with a lubricant material such as the aforesaid polytetrafluoroethylene or carbon.

Figure 9:
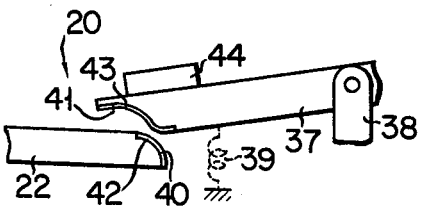
FIGS. 9 and 10 are side elevations of swing levers according to other embodiments of the invention and the parts associated therewith.

With a key unit 20 according to the embodiment of FIG. 9, a weight member 44 is mounted on the upper surface of the forward end portion of the swing lever 37 of FIG. 7. Where the swing lever 37 makes a counterclockwise rotation corresponding to FIG. 8(C), the inertia of the weight member 44 produces a more sense of "escape" and imparts a heavier impact on a player's finger tips, enabling the player to enjoy a better key touch sense as is derived from the ordinary piano. Obviously, the weight member 44 may be replaced by the tension spring 39. In this case, the elastic urging force of the tension spring 39 substitutes the inertia of the weight member 44.

Figure 10:
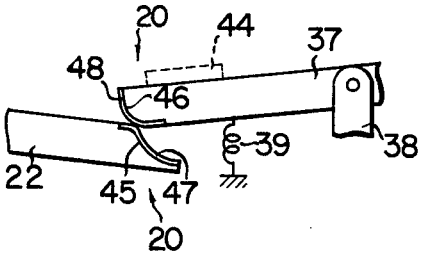

FIG. 10 shows another key unit 20. The rear end surface of a key shank 22 forms an upturned concave section 45, and the forward end surface of the swing lever 37 constitutes a downward directed convex section 46. Upon key depression, the rear end of the key shank 22 connected to the depressed key 21 is lifted. The upper part of the concave rear end surface 45 of the key shank 22 pushes up the lower part of the convex forward end surface 46 of the swing lever 37 in sliding contact with the convex surface 46, causing the swing lever 37 to be rotated clockwise.

Upon further key depression, the lower part of the convex forward end surface 46 of the swing lever 37 is disengaged from the upper part of the concave rear end surface 45 of the key shank 22. At this time, the swing lever 37 is slightly and rapidly rotated counterclockwise until the intermediate part of the convex forward end surface 46 of the swing lever 37 abuts against the intermediate part of the concave rear end surface 45 of the key shank 22, whereby imparting a mechanical impact to the key shank 22. This process has the effect of enabling a player to enjoy the same good key touch sence as is realized by the embodiments of FIGS. 4 to 6 and 8(A) to 8(C).

When, in the case of FIG. 10, sliding members 47, 48 prepared from a lubricant material such as the aforesaid polytetrafluoroethylene or carbon are coated on the concave rear end surface 45 of the key shank 22 and the convex forward end surface 46 of the swing lever 37, then the key unit 20 of FIG. 10 can be as smoothly operated as in the embodiment of FIG. 7. When a weight member 44 is mounted in place of the tension spring 39 or together therewith on the upper surface of the forward end portion of the swing lever 37, the same effect as in the embodiment of FIG. 9 is attained.

Figure 11:
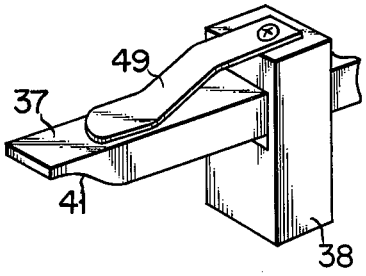
FIGS. 11 and 12 are perspective views of swing levers according to still other embodiments of the invention.
Figure 12:
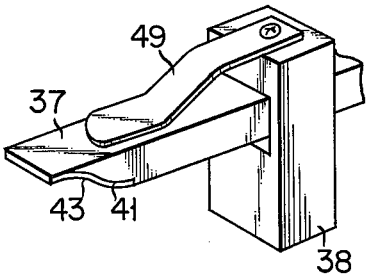

With the embodiments of FIGS. 4 to 10, the tension spring 39 was used to cause the swing lever 37 to be urged to the key shank 22. With the embodiments of FIGS. 11 and 12, the tension spring 39 is replaced by a leaf spring 49 whose rear end is fixed to the upper surface of a flange 38. This leaf spring 49 elastically presses the upper surface of the swing lever 37 in a counterclockwise direction. In FIG. 11, the underside of the forward end portion of the swing lever 37 forms a downward directed concave section 41 which is not provided with a sliding member. In FIG. 12, the concave element 41 is coated with a lubricating material 43 prepared from the same as in the embodiment of FIGS. 7 to 9. Where the rear end portion of the key shank 22 has an upturned concave surface, the forward end portion of the swing lever 37 of FIGS. 11 and 12 is made to have a downward-directed convex surface. It will be understood that the leaf spring 49 can replace the tension spring 39 with the same effect.

Figure 14:
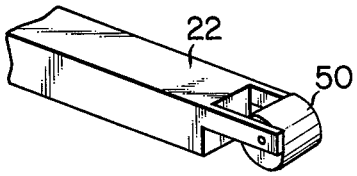
FIG. 14 is a perspective view of a key shank included in the key unit of FIG. 13.
Figure 15A:
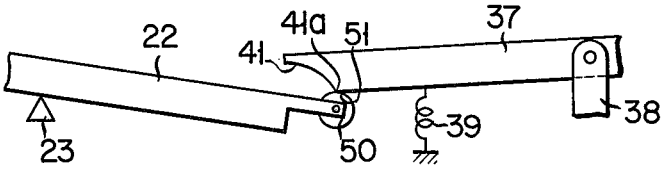
FIGS. 15(A) and 15(B) are side elevations showing the operation of the key unit.
Figure 15B:
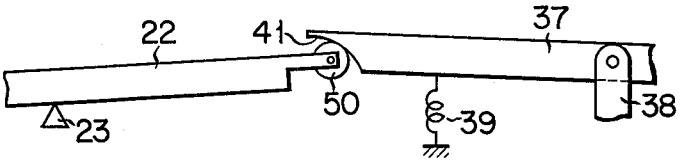

There will now be described a key unit according to the embodiment of FIGS. 13 and 14. With this embodiment, the convex surface (or convex section) 40 formed on the rear end portion of the key shank 22 of the embodiments of FIGS. 4 to 6 is replaced by a roller 50 provided at the rear end of the key shank 22 for engagement with the downward-directed concave surface (or concave section) 41 formed at the forward end portion of a swing lever 37. Where a key 21 is not depressed, that part 51 (FIG. 15(A)) of the underside of the spring lever 37 which is disposed near the lower edge 41*a* of the concave forward end surface 41 of the swing lever 37 rests on the roller 50. When the rear end portion of the key shank 22 is lifted upon key depression, the swing lever 37 is rotated clockwise due to the part 51 being pushed up in sliding contact with the roller 50. Thereafter, the roller 50 rolls beyond the lower edge 41*a*, causing the swing lever 37 to be rotated counterclockwise until the intermediate part of the roller 50 is engaged with the intermediate part of the concave forward end surface 41 of the swing lever 37. As a result, the key shank 22 receives a slight mechanical impact, enabling a player to enjoy a good key touch sense as in the embodiments of FIGS. 4, 7, 9, 11 and 12.

Figure 16:
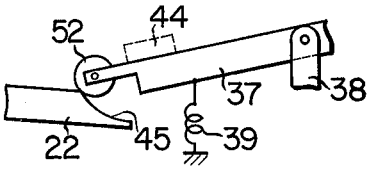
FIG. 16 indicates a key unit according to a still further embodiment of the invention.

With this embodiment of FIG. 16, a roller 52 is fitted to the forward end of a swing lever 37. The rear end of a key shank 22 is provided with an upturned concave surface (or concave section) 45 for engagement with the roller 52. The embodiment of FIG. 16 has substantially the same operation and effect as that of FIG. 13.

Figure 13:
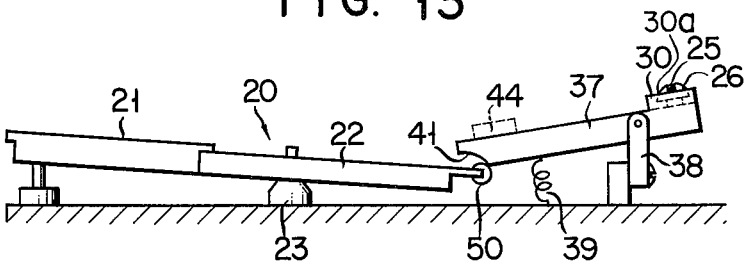
FIG. 13 is a side elevation of a key unit according to a further embodiment of the invention.

With the embodiments of FIGS. 13 and 16, a weight member 44 may be provided on the upper surface of the forward end portion of the swing lever 37 in place of the tension spring 39 or together therewith. This process attains the same effect as the weight member 44 used in the embodiment of FIG. 9. It is advisable to apply a sliding member made of a lubricant material having the same effect as that used in the embodiment of FIG. 7 on the concave forward end surface 41 of the swing lever 37 shown in FIG. 13 and also on the concave rear end surface 45 of the key shank 22 indicated in FIG. 16. The roller used with the embodiments of FIGS. 13 and 16 smoothly controls the rotation of the swing lever 37 directly associated with the production of a musical tone and presents a prominent practical merit.

As mentioned above, this invention provides a keyboard musical instrument of fully small size and light weight in which a plurality of strings are used as tone generators without such a complicated key action mechanism as is required for the conventional piano, and which produces musical tones effectively containing high harmonics, thereby generating percussive tones having the same quality as is derived from the ordinary piano.

What is claimed is:

1. A keyboard musical instrument comprising:

a plurality of juxtaposed key units, each provided with a playing key at one end; p1 a plurality of juxtaposed strings, each string having an effective length to produce a musical tone at a prescribed frequency, one end of each of said strings being directly and fixedly connected to the other end of a corresponding one of said key units and the other end thereof being immovably fixed to the body of said musical instrument;

damping means which is pressed against said strings when the corresponding key units are not operated, thereby suppressing the vibration of said strings; and pickup means disposed close to each string at right angles thereto so as to electrically detect the vibrations of said each string produced upon operation of the corresponding one of said key units.

2. The keyboard musical instrument according to claim 1, wherein each of the key units comprises a key shank, to one end of which the corresponding key is fixed, the intermediate part of which is rotatably supported and the other end of which is directly connected to said one end of the corresponding one of said strings.

3. The keyboard musical instrument according to claim 1, wherein each of said key units has a lengthwise direction, and each of said strings extends at substantially a right angle to the lengthwise direction of its respective key units.

4. The keyboard musical instrument according to claim 1, wherein there is further provided a pair of string supporting members for normally holding the corresponding one of the strings at portions near both ends thereof for defining the effective length of said one of the strings to be a distance at which the paired string supporting members are spaced from each other, one of said pair of string supporting members being provided on the corresponding key unit and the other of said pair of string supporting members being fixed to the body of the material instrument.

5. The keyboard musical instrument according to claim 4, wherein each of the string supporting members has a triangular cross section and defines an apical edge, and the corresponding one of the strings rests on the apical edge of said supporting members.

6. The keyboard musical instrument according to claim 1, wherein each of the key units comprises a key shank, to one end of which the corresponding key is fixed and the intermediate part of which is rotatably supported; a swing lever, one end of which is directly connected to said one end of the corresponding one of said strings, the intermediate part of which is rotatably supported and the other end of which extends above the other end of the key shank; and urging means for normally urging the swing lever toward the key shank.

7. The keyboard musical instrument according to claim 6, wherein the other end of either of the key shank and the swing lever forms a concave section.

8. The keyboard musical instrument according to claim 7, wherein said other end of the other of the swing lever and the key shank is provided with a roller engageable with said concave section.

9. The keyboard musical instrument according to calim 7, wherein said other end of the other of the key shank and the swing lever forms a convex section engageable with said concave section.

10. The keyboard musical instrument according to claim 9, wherein the concave section and convex section are each coated with a lubricant material.

11. The keyboard musical instrument according to claim 6, wherein the urging means comprises a helical spring.

12. The keyboard musical instrument according to claim 6, wherein the urging means comprises a leaf spring.

13. The keyboard musical intrument according to claim 6, wherein the urging means comprises a weight member mounted on the swing lever.

14. The keyboard musical instrument according to claim 6, wherein the urging means comprises a combination of a helical spring and a weight member mounted on the swing lever.

15. The keyboard musical instrument according to claim 6, wherein the urging means comprises a combination of a leaf spring and a weight member mounted on the swing lever.

* * * * *

UNITED STATES PATENT AND TRADEMARK OFFICE

CERTIFICATE OF CORRECTION

PATENT NO. : 4,091,702

DATED : May 30, 1978

INVENTOR(S) : Kazuo MURAKAMI

It is certified that error appears in the above-identified patent and that said Letters Patent are hereby corrected as shown below:

Column 7, line 39, delete "p1";

Column 8, line 3, after "key" change "units" to --unit--;

Column 8, line 14, change "material" to --musical--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*